US011339798B2

(12) United States Patent
Bielicki et al.

(10) Patent No.: US 11,339,798 B2
(45) Date of Patent: May 24, 2022

(54) SPLIT NOSE BLOWER SCROLL

(71) Applicant: DENSO International America, Inc., Southfield, MI (US)

(72) Inventors: Bradley Bielicki, Livonia, MI (US); Raymond Bailey, Northville, MI (US); Brian Belanger, Farmington Hills, MI (US); Jason Wagnitz, Farmington Hills, MI (US); Simon Hotte, Windsor (CA)

(73) Assignee: DENSO International America, Inc., Southfield, MI (US)

( * ) Notice: Subject to any disclaimer, the term of this patent is extended or adjusted under 35 U.S.C. 154(b) by 111 days.

(21) Appl. No.: 16/818,831

(22) Filed: Mar. 13, 2020

(65) Prior Publication Data

US 2021/0285458 A1 Sep. 16, 2021

(51) Int. Cl.
*F04D 29/42* (2006.01)
*F04D 17/16* (2006.01)

(52) U.S. Cl.
CPC ..... *F04D 29/422* (2013.01); *F04D 17/162* (2013.01); *F04D 29/4246* (2013.01)

(58) Field of Classification Search
CPC .... F04D 29/422; F04D 29/4246; F04D 17/16; F04D 17/162; F04D 17/165
See application file for complete search history.

(56) References Cited

U.S. PATENT DOCUMENTS

| | | | | |
|---|---|---|---|---|
| 4,944,654 | A | 7/1990 | Chou et al. | |
| 10,247,199 | B2 * | 4/2019 | Lee | F04D 25/08 |
| 2010/0044468 | A1 * | 2/2010 | Granger | F04D 25/163 239/304 |
| 2011/0280748 | A1 * | 11/2011 | O'Connor, Jr. | F04D 29/4246 417/410.1 |

FOREIGN PATENT DOCUMENTS

| | | | |
|---|---|---|---|
| JP | H11115450 | A | 4/1999 |
| JP | 2010100108 | A | 5/2010 |
| JP | 5246150 | B2 | 7/2013 |

* cited by examiner

*Primary Examiner* — Richard A Edgar
(74) *Attorney, Agent, or Firm* — Harness, Dickey & Pierce, P.L.C.

(57) ABSTRACT

A blower assembly including a scroll having a first airflow deflector nose and a second airflow deflector nose, which are offset relative to each other about a circumference of the scroll. A rotor is housed within the scroll. The first airflow deflector nose is configured to deflect airflow generated by the rotor out of the scroll to a first outlet of the blower assembly. The second airflow deflector nose is configured to deflect airflow generated by the rotor out of the scroll to a second outlet of the blower assembly.

14 Claims, 5 Drawing Sheets

SPLIT NOSE BLOWER SCROLL

FIELD

The present disclosure relates to a blower scroll, such as a blower scroll for a heating, ventilation, and air conditioning (HVAC) system.

BACKGROUND

This section provides background information related to the present disclosure, which is not necessarily prior art.

Heating, ventilation, and air conditioning (HVAC) systems typically include a blower assembly having a scroll housing a rotor, and a joint duct extending from the scroll. The joint duct directs airflow generated by the rotor to an evaporator of the HVAC system. With current blower assemblies, the joint duct directs airflow from the blower to the evaporator in a single unified mass. Airflow velocity within the joint duct is not uniform, and as a result airflow to the evaporator is not uniform, which may reduce overall HVAC performance.

SUMMARY

This section provides a general summary of the disclosure, and is not a comprehensive disclosure of its full scope or all of its features.

The present disclosure provides for a blower assembly including a scroll having a first airflow deflector nose and a second airflow deflector nose, which are offset relative to each other about a circumference of the scroll. A rotor is housed within the scroll. The first airflow deflector nose is configured to deflect airflow generated by the rotor out of the scroll to a first outlet of the blower assembly. The second airflow deflector nose is configured to deflect airflow generated by the rotor out of the scroll to a second outlet of the blower assembly.

The present disclosure further provides for a blower assembly having a scroll including a first airflow deflector nose spaced apart from a second airflow deflector nose. A rotor is housed within the scroll. A first joint duct extends from the scroll and defines a first outlet at an end of the first joint duct. A second joint duct extends from the scroll and defines a second outlet at an end of the second joint duct. The first airflow deflector nose deflects airflow generated by the rotor through the first joint duct and out of the blower assembly through the first outlet. The second airflow deflector nose deflects airflow generated by the rotor through the second joint duct and out of the blower assembly through the second outlet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

FIGS. 1-5 illustrate a blower assembly 10 in accordance with the present disclosure. The blower assembly 10 is configured for use with any suitable heating, ventilation, and air conditioning (HVAC) system, such as a vehicle HVAC system, for example. The blower assembly 10 may also be configured for use with any other suitable system that calls for circulation of airflow therethrough.

Figure 1:
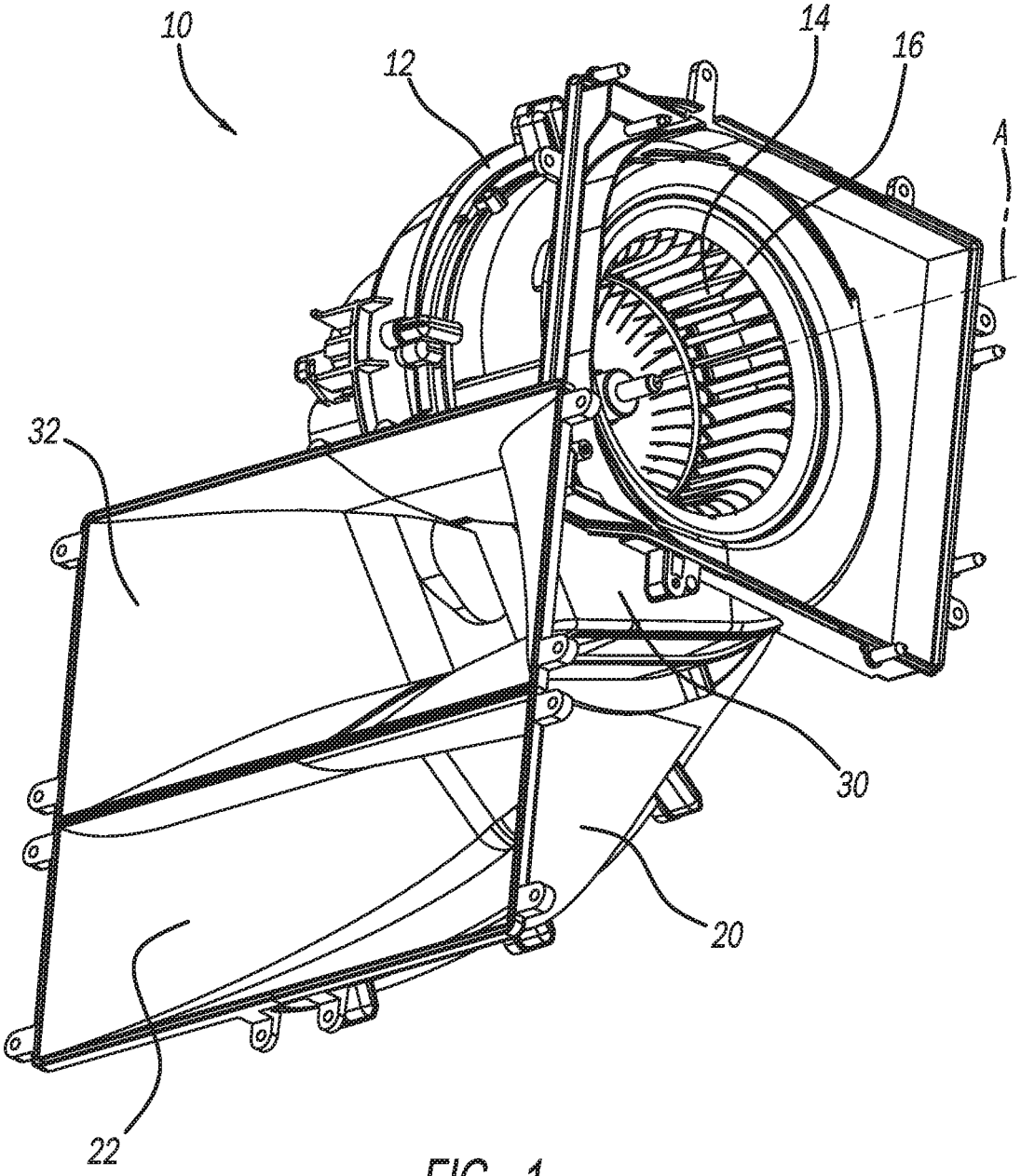
FIG. 1 is a perspective view of an exemplary blower assembly in accordance with the present disclosure.
Figure 2:
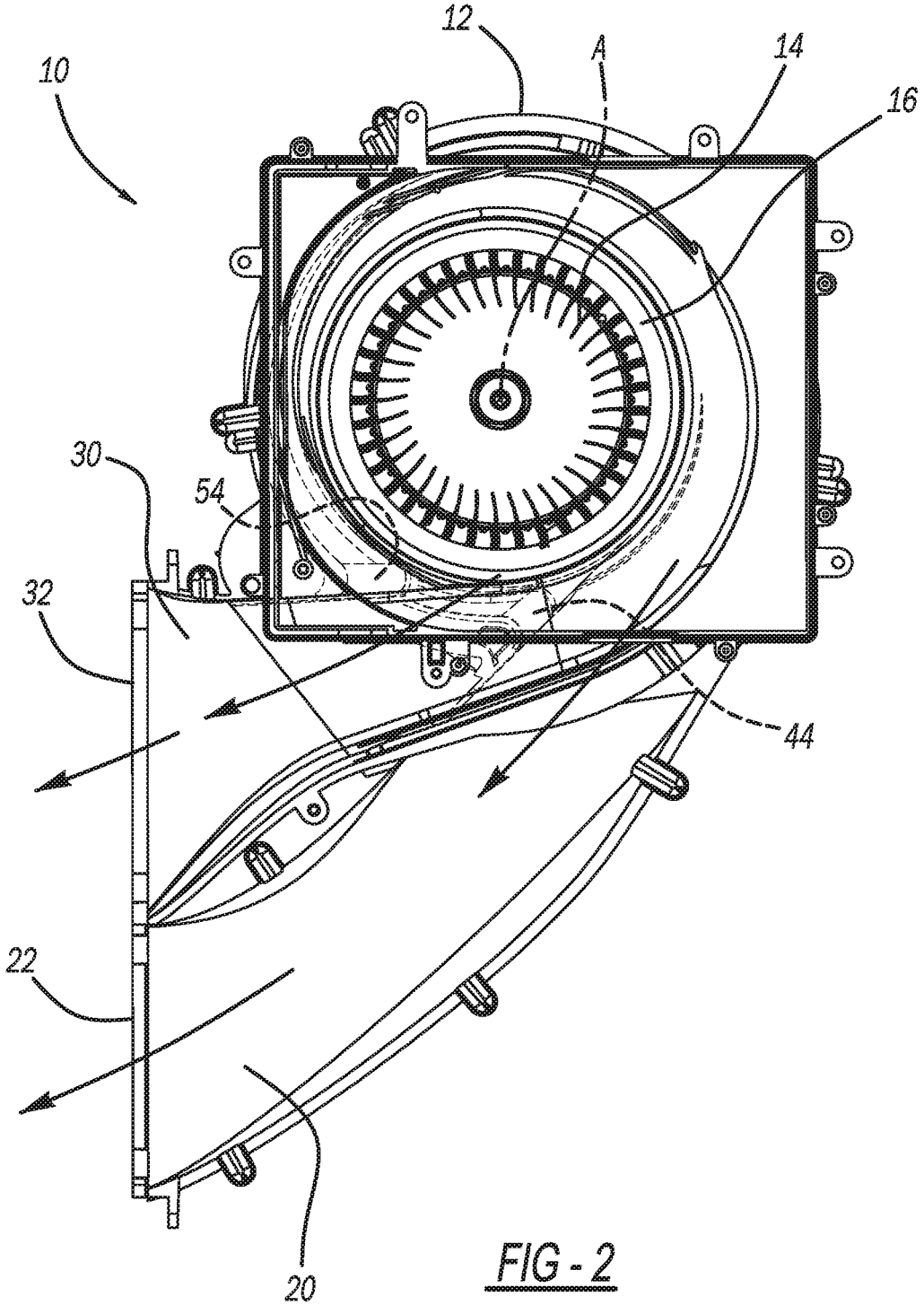
FIG. 2 is a side view of the blower assembly of FIG. 1.

With particular reference to FIGS. 1 and 2, the blower assembly 10 includes a scroll 12, which houses a rotor 14. The rotor 14 is configured to rotate and draw airflow into the scroll 12 through an inlet 16 of the scroll 12, which is also an inlet of the blower assembly 10. The rotor 14 rotates about an axis of rotation A. The rotor 14 may be replaced with any other suitable device for drawing air into the blower assembly 10, such as a fan.

A blower assembly 10 further includes a first joint duct 20 and a second joint duct 30, each of which extends from the scroll 12. The first joint duct 20 defines a first outlet 22, and the second joint duct 30 defines a second outlet 32. The second joint duct 30 is between the first joint duct 20 and the scroll 12. The first and second outlets 22, 32 face in a direction that is generally perpendicular to the axis of rotation A. The first and second outlets 22, 32 may also be configured to face in a direction that is generally parallel to the axis of rotation A The first outlet 22 and the second outlet 32 are aligned vertically relative to one another. The first joint duct 20 and the second joint duct 30 may be connected to an HVAC case of any suitable HVAC system at the first outlet 22 and the second outlet 32.

Airflow generated by the rotor 14 circulates about the scroll 12 and exits the scroll 12 through the first joint duct 20 and the second joint duct 30. The airflow ultimately exits the blower assembly 10 through the first outlet 22 and the second outlet 32. Airflow exiting the blower assembly 10 through the first outlet 22 and the second outlet 32 may be directed to an evaporator of an HVAC case to which the first joint duct 20 and the second joint duct 30 are connected to.

Figure 3:
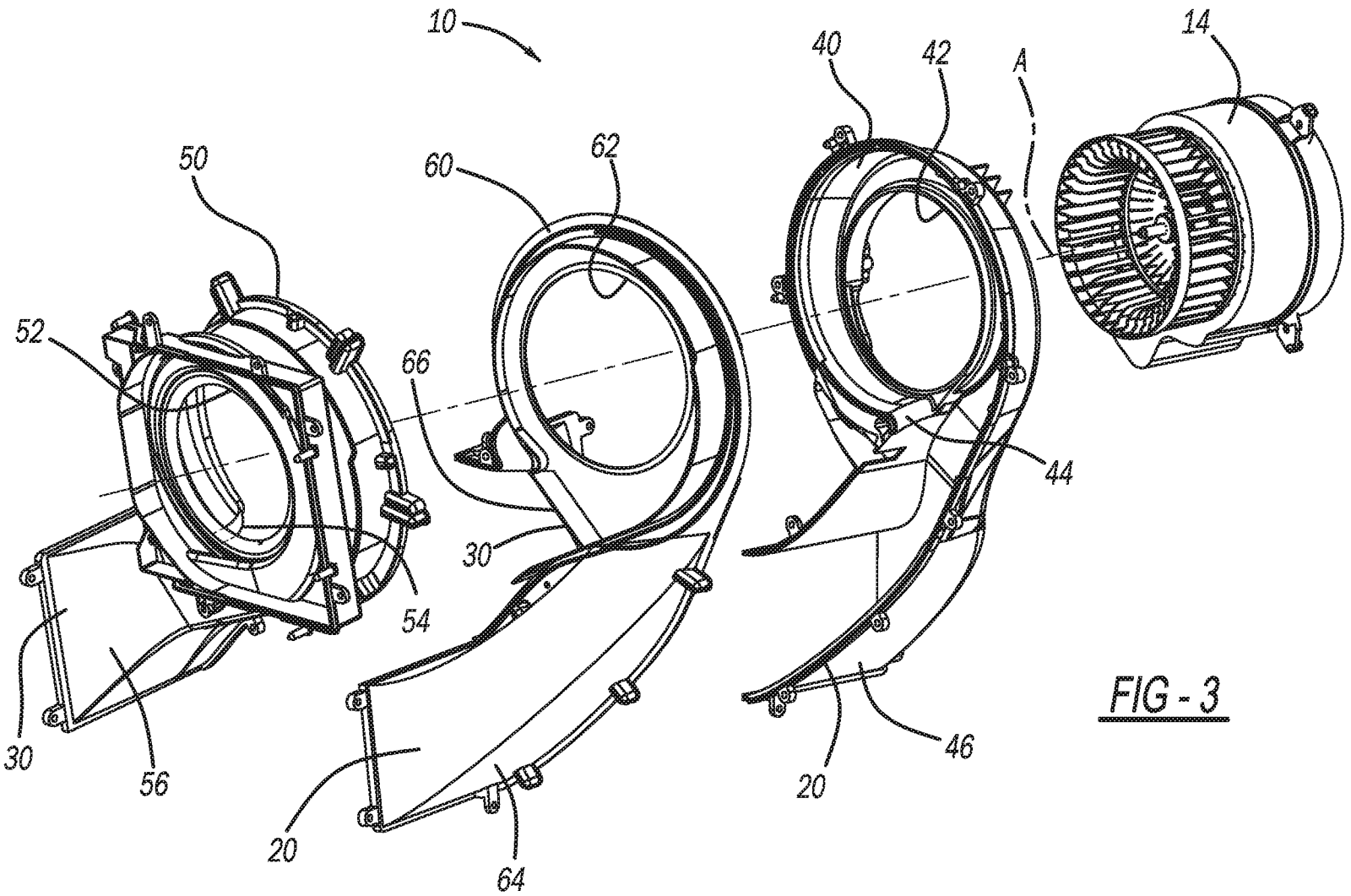
FIG. 3 is a first exploded view of the blower assembly of FIG. 1.
Figure 4:
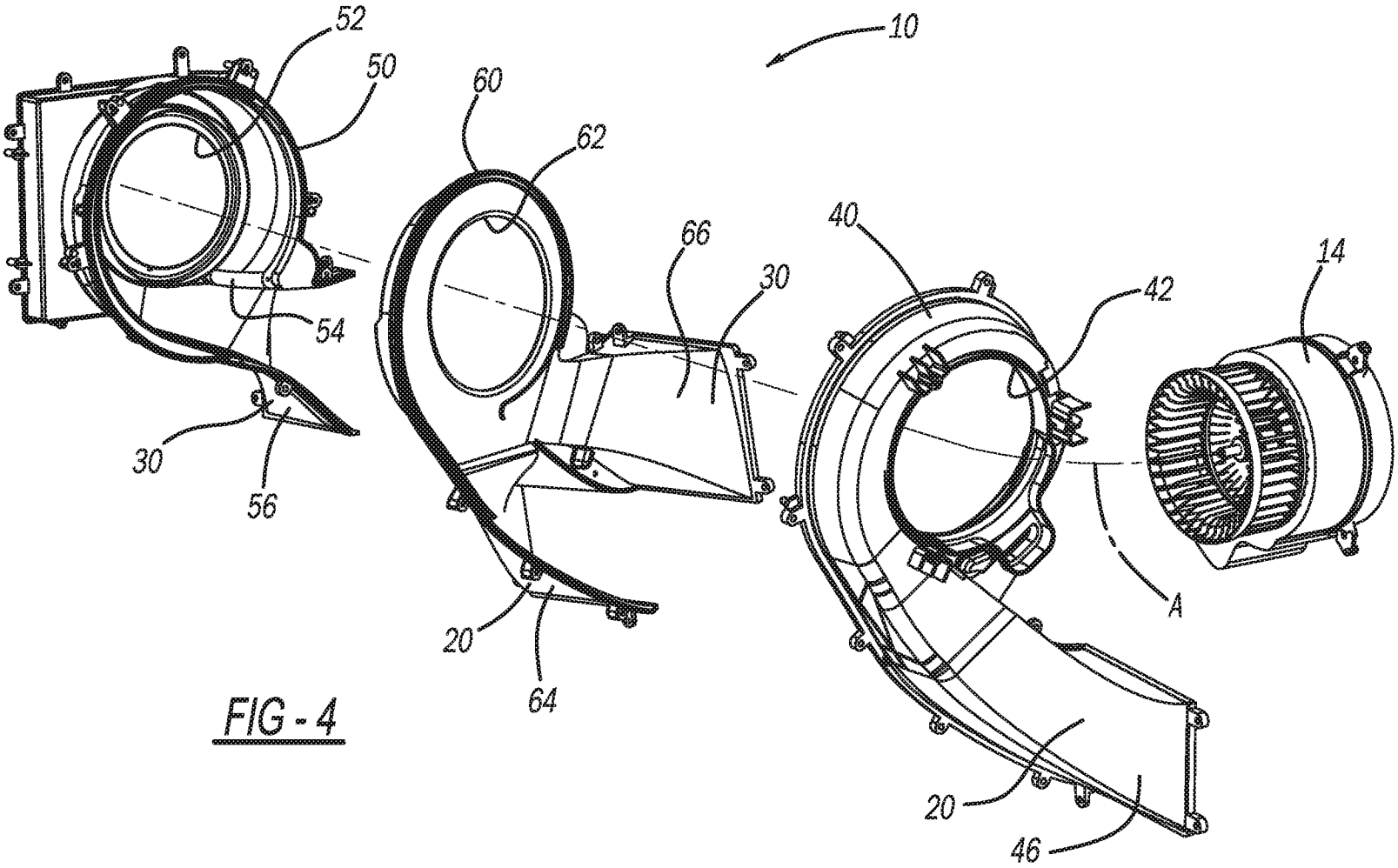
FIG. 4 is a second exploded view of the blower assembly of FIG. 1.

With additional reference to FIGS. 3-5, additional features of the blower assembly 10 will now be described. The scroll 12 includes a first scroll portion 40 on a first side/end of the scroll 12, and a second scroll portion 50 on a second side/end of the scroll 12. Between the first scroll portion 40 and the second scroll portion 50 is an intermediate scroll portion 60. The first scroll portion 40, the second scroll portion 50, and the intermediate scroll portion 60 are connected together in any suitable manner to define the scroll 12, such as with any suitable fasteners.

The first scroll portion 40 defines a first aperture 42. The rotor 14 is mounted within the scroll 12 such that the axis of rotation A of the rotor 14 is aligned with an axial center of the first aperture 42. At an interior of the first scroll portion 40 is a first airflow deflector nose 44. The first airflow deflector nose 44 is generally arranged where the first joint duct 20 extends from the scroll 12. More specifically and with respect to the exemplary blower assembly 10 illustrated, the first airflow deflector nose 44 is where a first portion 46 of the first joint duct 20 extends from the first scroll portion 40. The first airflow deflector nose 44 deflects airflow out of the first scroll portion 40 and into the first joint duct 20.

The second scroll portion 50 defines a second aperture 52. The rotor 14 is arranged such that the rotational axis A thereof is aligned with an axial center of the second aperture 52. On an inner surface of the second scroll portion 50 is a second airflow deflector nose 54. The second airflow deflector nose 54 is at an outer circumference of the second scroll portion 50 where the second joint duct 30 extends from the second scroll portion 50. More specifically and with respect to the exemplary blower assembly 10 illustrated, the second airflow deflector nose 54 is where a first portion 56 of the second joint duct 30 extends from the second scroll portion 50. The second airflow deflector nose 54 deflects airflow out of the second scroll portion 50 and into the second joint duct 30.

The intermediate scroll portion 60 defines an intermediate aperture 62. The axis of rotation A of the rotor 14 extends through a radial center of the intermediate aperture 62. Extending from the intermediate scroll portion 60 is a second portion 64 of the first joint duct 20, and a second portion 66 of the second joint duct 30. When the blower assembly 10 is fully assembled, such as illustrated in FIGS. 1 and 2, the first portion 46 and the second portion 64 of the first joint duct 20 are connected in any suitable manner, such as with any suitable fastener, to form the first joint duct 20. Similarly, the first portion 56 and the second portion 66 of the second joint duct 30 are connected in any suitable manner, such as with any suitable fastener, to form the second joint duct 30.

Figure 5:
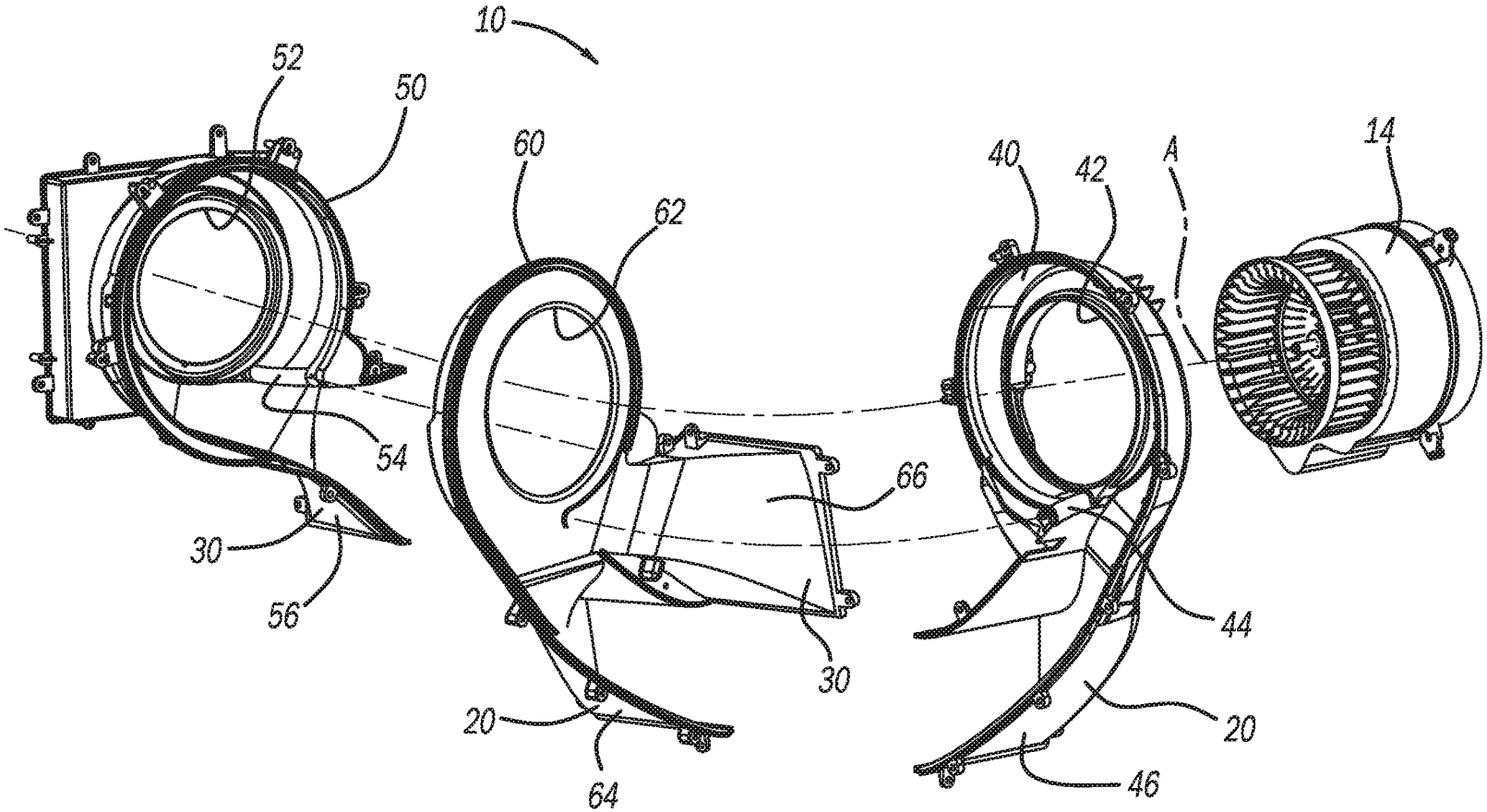
FIG. 5 is a third exploded view of the blower assembly of FIG. 1.

With particular reference to FIGS. 2 and 5, the first airflow deflector nose 44 and the second airflow deflector nose 54 are offset relative to each other about a circumference of the scroll 12. The first and second airflow deflector noses 44, 54 are thus spaced apart and not aligned with one another. The first and second airflow deflector noses 44, 54 are separate noses, which is in contrast to existing blower assemblies, which include only a single nose extending along a single line parallel to an axis of rotation of a blower. Thus, existing blower assemblies include only a single joint duct and only a single outlet, which is in contrast to the first and second joint ducts 20 and 30 having first and second outlets 22 and 32.

The first airflow deflector nose 44 deflects airflow from the first scroll portion 40 into the first joint duct 20. From the first joint duct 20 airflow exits the blower assembly 10 through the first outlet 22, and typically flows to an evaporator of an HVAC system. The second airflow deflector nose 54 deflects airflow from the second scroll portion 50 into the second joint duct 30. From the second joint duct 30 airflow exits the blower assembly 10 through the second outlet 32, and typically flows to the evaporator. The separate first and second joint ducts 20, 30 (and the separate outlets 22, 32 thereof) advantageously allow for greater control over the direction of airflow exiting the blower assembly 10 so that the airflow may be spread evenly over the evaporator.

Using the separate first and second joint ducts 20, 30, airflow from the blower assembly 10 may be adjusted to direct airflow to strategic locations of the evaporator to make the airflow across the evaporator more uniform, which enhances overall performance of the HVAC system. The first and second joint ducts 20, 30 can be adjusted in any suitable manner. For example, by decoupling the first scroll portion 40 and the second scroll portion 50, and rotating the portions 40, 50 relative to one another before recoupling them (and reconfiguring the intermediate scroll portion 60 so that second portions 64 and 66 are spaced further apart), the degree to which the first airflow deflector nose 44 and the second airflow deflector nose 54 are offset can be changed and the orientation of the first and second joint ducts 20, 30 can be changed. With reference to FIG. 2, the second scroll portion 50 may be rotated slightly clockwise, for example, which will result in the second joint duct 30 being rotated slightly clockwise to direct airflow from the second outlet 32 slightly upward as compared to the configuration of FIG. 2. Airflow from the blower assembly 10 to an evaporator can thus advantageously be "tuned" to provide more even and uniform airflow across the evaporator, thereby increasing the efficiency of the evaporator and the overall HVAC system.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A blower assembly comprising:

a scroll including a first scroll portion, a second scroll portion, and an intermediate scroll portion between the first scroll portion and the second scroll portion;

a first airflow deflector nose of the scroll and a second airflow deflector nose of the scroll, which are offset relative to each other about a circumference of the scroll;

a rotor housed within the scroll;

a first outlet of the blower assembly defined by a first joint duct extending from both the first scroll portion and the intermediate scroll portion; and a second outlet of the blower assembly defined by a second joint duct extending from both the second scroll portion and the intermediate scroll portion, the second joint duct is between the first joint duct and the scroll;

wherein:

the first airflow deflector nose is configured to deflect airflow generated by the rotor out of the scroll to the first outlet; and the second airflow deflector nose is configured to deflect airflow generated by the rotor out of the scroll to the second outlet.

2. The blower assembly of claim 1, wherein the first outlet and the second outlet face in a direction perpendicular or parallel to a rotational axis of the rotor.

3. The blower assembly of claim 1, wherein the first outlet and the second outlet face in a direction perpendicular or parallel to an inlet of the scroll.

4. The blower assembly of claim 1, wherein the first scroll portion includes the first airflow deflector nose, and the second scroll portion includes the second airflow deflector nose.

5. The blower assembly of claim 4, wherein the first airflow deflector nose directs airflow generated by the rotor through the first joint duct to the first outlet, and the second airflow deflector nose directs airflow generated by the rotor through the second joint duct to the second outlet.

6. The blower assembly of claim 1, wherein the intermediate scroll portion defines an intermediate aperture in which the rotor is seated.

7. The blower assembly of claim 6, wherein at least one of the first scroll portion and the second scroll portion defines an inlet through which air flows into the rotor.

8. A blower assembly comprising:

a scroll including a first scroll portion, a second scroll portion, an intermediate scroll portion between the first scroll portion and the second scroll portion, and a first airflow deflector nose spaced apart from a second airflow deflector nose;

a rotor housed within the scroll;

a first joint duct extending from the scroll and defining a first outlet at an end of the first joint duct, a first portion of the first joint duct is defined by the first scroll portion and a second portion of the first joint duct is defined by the intermediate scroll portion; and a second joint duct extending from the scroll and defining a second outlet at an end of the second joint duct, the second joint duct is between the first joint duct and the scroll, a first portion of the second joint duct is defined by the second scroll portion and a second portion of the second joint duct is defined by the intermediate scroll portion;

wherein the first airflow deflector nose deflects airflow generated by the rotor through the first joint duct and out of the blower assembly through the first outlet; and wherein the second airflow deflector nose deflects airflow generated by the rotor through the second joint duct and out of the blower assembly through the second outlet.

9. The blower assembly of claim 8, wherein the first airflow deflector nose and the second airflow deflector nose are spaced apart about a circumference of the scroll.

10. The blower assembly of claim 8, wherein the first outlet and the second outlet face in a direction perpendicular or parallel to a rotational axis of the rotor.

11. The blower assembly of claim 8, wherein the first outlet and the second outlet face in a direction perpendicular or parallel to an inlet of the scroll.

12. The blower assembly of claim 8, wherein the first scroll portion includes the first airflow deflector nose and the second scroll portion includes the second airflow deflector nose.

13. The blower assembly of claim 8, wherein the intermediate scroll portion defines an intermediate aperture in which the rotor is seated.

14. The blower assembly of claim 13, wherein at least one of the first scroll portion and the second scroll portion defines an inlet through which air flows into the rotor.

* * * * *